US011162243B2

(12) United States Patent
Olsson

(10) Patent No.: US 11,162,243 B2
(45) Date of Patent: Nov. 2, 2021

(54) ENERGY BUFFER ARRANGEMENT AND METHOD FOR REMOTE CONTROLLED DEMOLITION ROBOT

(71) Applicant: HUSQVARNA AB, Huskvarna (SE)

(72) Inventor: Tommy Olsson, Mölndal (SE)

(73) Assignee: HUSQVARNA AB, Huskvarna (SE)

( * ) Notice: Subject to any disclaimer, the term of this patent is extended or adjusted under 35 U.S.C. 154(b) by 175 days.

(21) Appl. No.: 15/769,253

(22) PCT Filed: Oct. 19, 2016

(86) PCT No.: PCT/SE2016/051014

§ 371 (c)(1),
(2) Date: Apr. 18, 2018

(87) PCT Pub. No.: WO2017/069688

PCT Pub. Date: Apr. 27, 2017

(65) Prior Publication Data

US 2018/0305897 A1 Oct. 25, 2018

(30) Foreign Application Priority Data

Oct. 19, 2015 (SE) ..... 1551348-4

(51) Int. Cl.
*E02F 9/22* (2006.01)
*E02F 9/20* (2006.01)
(Continued)

(52) U.S. Cl.
CPC ..... *E02F 9/2217* (2013.01); *E02F 3/966* (2013.01); *E02F 9/205* (2013.01); *E02F 9/207* (2013.01);
(Continued)

(58) Field of Classification Search
CPC ... F15B 1/024; F15B 1/033; F15B 2211/6326
See application file for complete search history.

(56) References Cited

U.S. PATENT DOCUMENTS 2,008,053 A 7/1935 Whiteside
2,160,217 A 5/1939 Kingsbury
(Continued)

FOREIGN PATENT DOCUMENTS

CN 1457398 A 11/2003
CN 101245871 A 8/2008
(Continued)

OTHER PUBLICATIONS

International Search Report and Written Opinion for International Application No. PCT/SE2016/051021 dated Jan. 12, 2017.
(Continued)

*Primary Examiner* — F Daniel Lopez
*Assistant Examiner* — Matthew Wiblin
(74) *Attorney, Agent, or Firm* — Burr & Forman, LLP

(57) ABSTRACT

A remote controlled demolition robot (10) comprising a controller (17) and at least one actuator (12) controlled through a hydraulic system (400) comprising at least one valve (13*a*) and a hydraulic gas accumulator (440), wherein the controller (17) is configured to determine a fluid flow in the hydraulic system (400), determine if the determined fluid flow in the hydraulic system is above a first threshold, and if so discharge the accumulator (440) to provide power to the actuator (12); and determine if the determined fluid flow in the hydraulic system is below a second threshold, and if so charge the accumulator (440) for buffering power in the hydraulic system (400).

20 Claims, 5 Drawing Sheets

(51) Int. Cl.
*E02F 3/96* (2006.01)
*F15B 1/02* (2006.01)
*E04G 23/08* (2006.01)

(52) U.S. Cl.
CPC ..... *E04G 23/081* (2013.01); *F15B 1/024* (2013.01); *E02F 9/2221* (2013.01)

(56) References Cited

U.S. PATENT DOCUMENTS

| | | | | |
|---|---|---|---|---|
| 2,214,389 | A | 9/1940 | Wahlmark | |
| 2,427,970 | A | 9/1947 | Mathys | |
| 3,228,659 | A | 1/1966 | Sturm | |
| 3,779,017 | A * | 12/1973 | Fujisawa | B66B 1/24 60/413 |
| 3,963,039 | A | 6/1976 | Coeurderoy | |
| 4,121,610 | A | 10/1978 | Harms et al. | |
| 4,215,545 | A * | 8/1980 | Morello | B60K 6/12 60/413 |
| 5,222,417 | A | 6/1993 | Sato | |
| 5,235,809 | A | 8/1993 | Farrell | |
| 5,355,676 | A * | 10/1994 | Inokuchi | F15B 1/02 60/413 |
| 6,058,632 | A | 5/2000 | Hawkins | |
| 6,138,810 | A | 10/2000 | Fujii et al. | |
| 6,305,162 | B1 | 10/2001 | Cobo et al. | |
| 6,397,655 | B1 | 6/2002 | Stephenson | |
| 6,571,190 | B2 | 5/2003 | Hou et al. | |
| 6,792,902 | B2 | 9/2004 | Simpson | |
| 7,076,947 | B2 | 7/2006 | Ariga et al. | |
| 7,412,827 | B2 | 8/2008 | Verkuilen | |
| 7,434,393 | B2 | 10/2008 | Hesse | |
| 7,441,405 | B2 | 10/2008 | Aarestad et al. | |
| 7,878,770 | B2 | 2/2011 | Oka | |
| 8,061,180 | B2 | 11/2011 | Green | |
| 8,186,155 | B2 | 5/2012 | Rose et al. | |
| 8,281,757 | B2 | 10/2012 | Tomimatsu et al. | |
| 8,321,096 | B2 | 11/2012 | Sandstrom et al. | |
| 2004/0206155 | A1 | 10/2004 | Sosnowski | |
| 2008/0053191 | A1 | 3/2008 | Yoo et al. | |
| 2010/0043421 | A1 | 2/2010 | Rub | |
| 2011/0061448 | A1 | 3/2011 | Cadman et al. | |
| 2011/0197576 | A1 | 8/2011 | Wada et al. | |
| 2011/0282519 | A1 | 11/2011 | Carlsson | |
| 2012/0137667 | A1 | 6/2012 | Jacobsen et al. | |
| 2012/0192779 | A1 * | 8/2012 | Teppig, Jr. | B63B 25/12 114/256 |
| 2013/0000291 | A1 * | 1/2013 | Nelson | F15B 21/14 60/327 |
| 2013/0068309 | A1 | 3/2013 | Anderson | |
| 2013/0219877 | A1 | 8/2013 | Hughes et al. | |
| 2013/0287601 | A1 | 10/2013 | Mori et al. | |
| 2013/0297045 | A1 | 11/2013 | Yuan et al. | |
| 2013/0312397 | A1 | 11/2013 | Callaway et al. | |
| 2013/0332036 | A1 | 12/2013 | Yamamoto et al. | |
| 2014/0060020 | A1 | 3/2014 | Peterson et al. | |
| 2014/0060030 | A1 * | 3/2014 | Ma | E02F 9/123 60/413 |
| 2014/0174069 | A1 | 6/2014 | Kuehn et al. | |
| 2015/0047333 | A1 * | 2/2015 | Hendrix | F16H 61/4061 60/413 |
| 2015/0113969 | A1 | 4/2015 | Kochhan et al. | |
| 2015/0136505 | A1 | 5/2015 | Bystedt | |
| 2015/0159682 | A1 | 6/2015 | Bae et al. | |
| 2015/0240455 | A1 | 8/2015 | Takebayashi et al. | |
| 2015/0299987 | A1 | 10/2015 | Ueda | |
| 2017/0009632 | A1 * | 1/2017 | Seo | F01N 5/02 |

FOREIGN PATENT DOCUMENTS

| | | | | |
|---|---|---|---|---|
| CN | 101278131 | A | 10/2008 | |
| CN | 101763121 | A | 6/2010 | |
| CN | 102165201 | A | 8/2011 | |
| CN | 102365186 | A | 2/2012 | |
| CN | 102365466 | A | 2/2012 | |
| CN | 203035627 | U | 7/2013 | |
| DE | 103 40 993 | A1 | 3/2005 | |
| DE | 103 42 037 | A1 | 4/2005 | |
| EP | 0 796 952 | A1 | 9/1997 | |
| EP | 2251549 | A2 * | 11/2010 | F15B 1/024 |
| EP | 2 508 680 | A1 | 10/2012 | |
| EP | 2 589 709 | A2 | 5/2013 | |
| EP | 2589709 | A2 * | 5/2013 | E02F 9/2296 |
| JP | 2012141037 | A | 7/2012 | |
| SE | 1050386 | A1 | 10/2011 | |
| WO | 99/04936 | A1 | 2/1999 | |
| WO | 00/78510 | A2 | 12/2000 | |
| WO | 2014/207474 | A2 | 12/2014 | |
| WO | 2015/117960 | A1 | 8/2015 | |

OTHER PUBLICATIONS

International Search Report and Written Opinion for International Application No. PCT/SE2016/051014 dated Jan. 20, 2017.
International Search Report and Written Opinion for International Application No. PCT/SE2016/051015 dated Jan. 20, 2017.
International Preliminary Report on Patentability for International Application No. PCT/SE2016/051021 dated Apr. 24, 2018.
International Preliminary Report on Patentability for International Application No. PCT/SE2016/051014 dated Apr. 24, 2018.
International Preliminary Report on Patentability for International Application No. PCT/SE2016/051015 dated Apr. 24, 2018.
Wang Yongren, "Hydraulic Transmission Technology", Xian Jiaotong University Press, Aug. 31, 2013, p. 58.

* cited by examiner

ENERGY BUFFER ARRANGEMENT AND METHOD FOR REMOTE CONTROLLED DEMOLITION ROBOT

TECHNICAL FIELD

This application relates to the power provision to remote controlled demolition robots, and in particular to improved buffer arrangement in a hydraulic demolition robot.

BACKGROUND

Contemporary remote demolition robots suffer from a problem in that they are sometimes set to work in remote areas where they only operate on battery power. Or in environments where there are no high power outlets. For example, only 16 ampere outlets may be available. As demolition robots sometimes require higher currents to be able to operate, such as during usage of a tool, the demolition robots will become ineffective in such environments.

To overcome this, prior art demolition robots carry a battery to boost the power when needed. However, batteries become discharged and are charged at a much slower pace than they are discharged. As such, the use of batteries limits the operational time of a demolition robot.

There is thus a need for a remote demolition robot that is able to operate fully even in environments lacking high power outlets and for an extended operational time.

SUMMARY

On object of the present teachings herein is to solve, mitigate or at least reduce the drawbacks of the background art, which is achieved by the appended claims.

A first aspect of the teachings herein provides a remote controlled demolition robot comprising a controller and at least one actuator controlled through a hydraulic system comprising at least one valve and a hydraulic gas accumulator, wherein the controller is configured to determine a fluid flow in the hydraulic system, determine if the determined fluid flow in the hydraulic system is above a first threshold, and if so discharge the accumulator to provide power to the actuator; and determine if the determined fluid flow in the hydraulic system is below a second threshold, and if so charge the accumulator for buffering power in the hydraulic system.

The accumulator may be discharged through a hydraulic valve to increase the fluid flow in the hydraulic system using the buffered energy in stored the accumulator, and wherein the accumulator is charged by opening the hydraulic valve.

A second aspect of the teachings herein provides a hydraulic gas accumulator to be used in a demolition robot according to above.

A third aspect provides a method for use in a remote controlled demolition robot comprising at least one actuator controlled through a hydraulic system comprising at least one valve and a hydraulic gas accumulator, wherein the method comprises determining a fluid flow in the hydraulic system, determine if the determined fluid flow in the hydraulic system is above a first threshold, and if so discharging the accumulator to provide power to the actuator; and determining if the determined fluid flow in the hydraulic system is below a second threshold, and if so charging the accumulator for buffering power in the hydraulic system.

A fourth aspect provides a computer-readable medium comprising software code instructions, that when loaded in and executed by a controller causes the execution of a method according to herein.

One benefit is that a demolition robot will not need to carry a heavy and expensive battery. The remote controlled demolition robot also does not need advanced electronic for providing an energy buffer.

Other features and advantages of the disclosed embodiments will appear from the following detailed disclosure, from the attached dependent claims as well as from the drawings.

BRIEF DESCRIPTION OF DRAWING

The invention will be described below with reference to the accompanying figures wherein.

DETAILED DESCRIPTION

Figure 1:
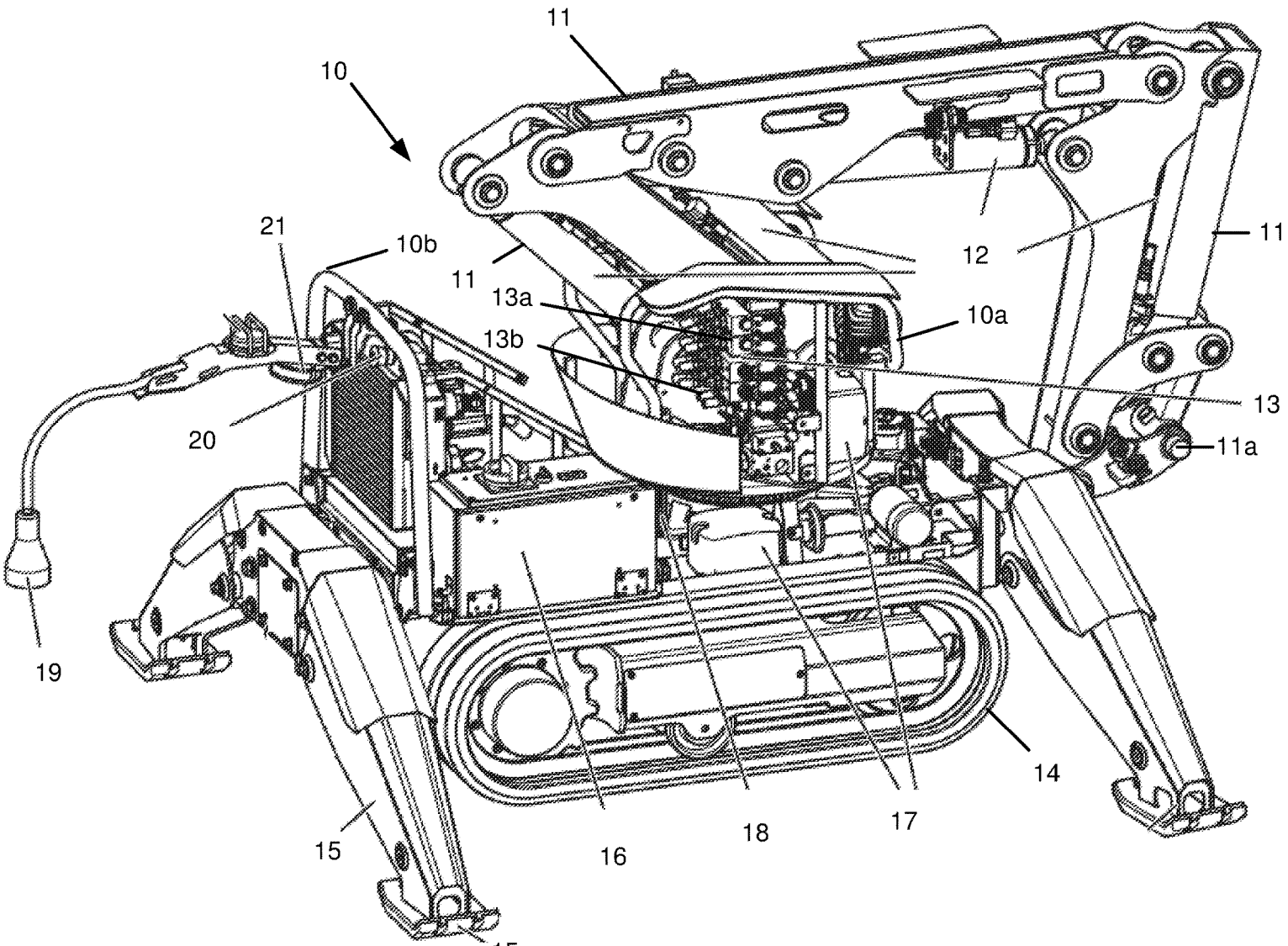
FIG. 1 shows a remote controlled demolition robot according to an embodiment of the teachings herein.

FIG. 1 shows a remote controlled demolition robot 10, hereafter simply referred to as the robot 10. The robot 10 comprises one or more robot members, such as arms 11, the arms 11 possibly constituting one (or more) robot arm member(s). One member may be an accessory tool holder 11*a* for holding an accessory 11*b* (not shown in FIG. 1, see FIG. 3). The accessory 11*b* may be a tool such as a hydraulic breaker or hammer, a cutter, a saw, a digging bucket to mention a few examples. The accessory may also be a payload to be carried by the robot 10. The arms 11 are movably operable through at least one cylinder 12 for each arm 11. The cylinders are preferably hydraulic and controlled through a hydraulic valve block 13 housed in the robot 10.

The hydraulic valve block 13 comprises one or more valves 13*a* for controlling the flow of hydraulic fluid (oil) provided to for example a corresponding cylinder 12. The valve 13*a* is a proportional hydraulic valve.

The valve block 13 also comprises (possibly by being connected to) one or more pressure sensors 13*b* for determining the pressure before or after a valve 13*a*.

Further details on the hydraulic system will be given with reference to FIG. 4 below.

The robot 10 comprises caterpillar tracks 14 that enable the robot 10 to move. The robot may alternatively or additionally have wheels for enabling it to move, both wheels and caterpillar tracks being examples of drive means. The robot further comprises outriggers 15 that may be extended individually (or collectively) to stabilize the robot 10. At least one of the outriggers 15 may have a foot 15*a* (possibly flexibly arranged on the corresponding outrigger 15) for providing more stable support in various environments. The robot 10 is driven by a drive system 16 operably connected to the caterpillar tracks 14 and the hydraulic valve block 13. The drive system may comprise an electrical motor in case of an electrically powered robot 10 powered by a battery and/or an electrical cable 19 connected to an electrical grid (not shown), or a cabinet for a fuel tank and an engine in case of a combustion powered robot 10.

The body of the robot 10 may comprise a tower 10*a* on which the arms 11 are arranged, and a base 10*b* on which the caterpillar tracks 14 are arranged. The tower 10*a* is arranged to be rotatable with regards to the base 10*b* which enables an operator to turn the arms 11 in a direction other than the direction of the caterpillar tracks 14.

The operation of the robot 10 is controlled by one or more controllers 17, comprising at least one processor or other programmable logic and possibly a memory module for storing instructions that when executed by the processor controls a function of the demolition robot 10. The one or more controllers 17 will hereafter be referred to as one and the same controller 17 making no differentiation of which processor is executing which operation. It should be noted that the execution of a task may be divided between the controllers wherein the controllers will exchange data and/or commands to execute the task.

The robot 10 may further comprise a radio module 18. The radio module 18 may be used for communicating with a remote control (see FIG. 2, reference 22) for receiving commands to be executed by the controller 17 The radio module 18 may be used for communicating with a remote server (not shown) for providing status information and/or receiving information and/or commands. The controller may thus be arranged to receive instructions through the radio module 18. The radio module may be configured to operate according to a low energy radio frequency communication standard such as ZigBee®, Bluetooth® or WiFi®. Alternatively or additionally, the radio module 18 may be configured to operate according to a cellular communication standard, such as GSM (Global System Mobile) or LTE (Long Term Evolution).

The robot 10, in case of an electrically powered robot 10) comprises a power cable 19 for receiving power to run the robot 10 or to charge the robots batteries or both. The robot may also operate solely or partially on battery power.

The robot 10, being a hydraulic robot, comprises a motor (not shown) that is arranged to drive a pump (referenced 410 in FIG. 4) for driving the hydraulic system. More details on the hydraulic system is given with reference to FIG. 4 below.

For wired control of the robot 10, the remote control 22 may alternatively be connected through or along with the power cable 19. The robot may also comprise a Human-Machine Interface (HMI), which may comprise control buttons, such as a stop button 20, and light indicators, such as a warning light 21.

Figure 2:
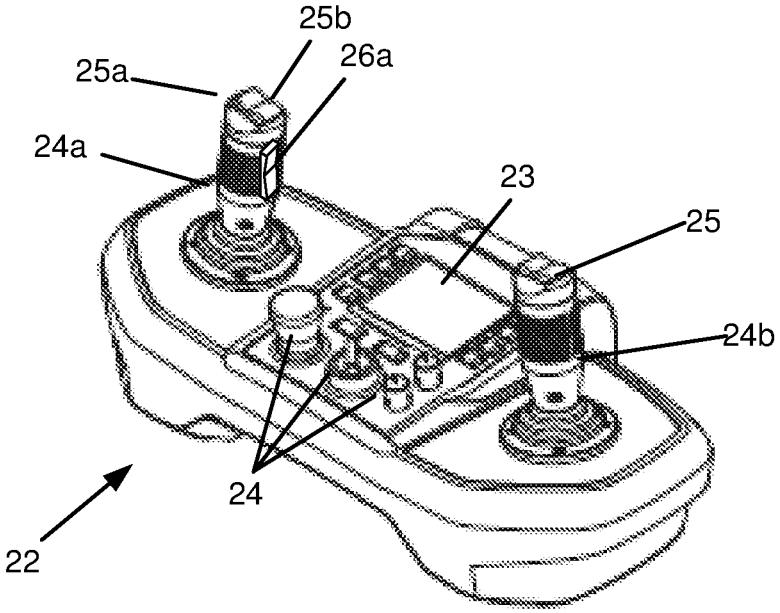
FIG. 2 shows a remote control 22 for a remote controlled demolition robot according to an embodiment of the teachings herein.

FIG. 2 shows a remote control 22 for a remote demolition robot such as the robot 10 in FIG. 1. The remote control 22 may be assigned an identity code so that a robot 10 may identify the remote control and only accept commands from a correctly identified remote control 22. This enables for more than one robot 10 to be working in the same general area. The remote control 22 has one or more displays 23 for providing information to an operator, and one or more controls 24 for receiving commands from the operator. The controls 24 include one or more joysticks, a left joystick 24*a* and a right joystick 24*b* for example as shown in FIG. 2, being examples of a first joystick 24*a* and a second joystick 24*b*. It should be noted that the labeling of a left and a right joystick is merely a labeling used to differentiate between the two joysticks 24*a*, 24*b*. A joystick 24*a*, 24*b* may further be arranged with a top control switch 25. In the example of FIG. 2A, each joystick 24*a*, 24*b* is arranged with two top control switches 25*a*, 25*b*. The joysticks 24*a*, 24*b* and the top control switches 25 are used to provide maneuvering commands to the robot 10. The control switches 24 may be used to select one out of several operating modes, wherein an operating mode determines which control input corresponds to which action. For example: in a Transport mode, the left joystick 24*a* may control the caterpillar tracks 14 and the right joystick 24*b* may control the tower 10*a* (which can come in handy when turning in narrow passages); whereas in a Work mode, the left joystick 24*a* controls the tower 10*a*, the tool 11*b* and some movements of the arms 11, and the right joystick 24*b* controls other movement of the arms 11; and in a Setup mode, the each joystick 24*a*, 24*b* controls each a caterpillar track 14, and also controls the outrigger(s) 15 on a corresponding side of the robot 10. It should be noted that other associations of functions to joysticks and controls are also possible.

The remote control 22 may be seen as a part of the robot 10 in that it is the control panel of the robot 10. This is especially apparent when the remote control is connected to the robot through a wire. However, the remote control 22 may be sold separately to the robot 10 or as an additional accessory or spare part.

The remote control 22 is thus configured to provide control information, such as commands, to the robot 10 which information is interpreted by the controller 17, causing the robot 10 to operate according to the actuations of the remote control 22.

Figure 3:
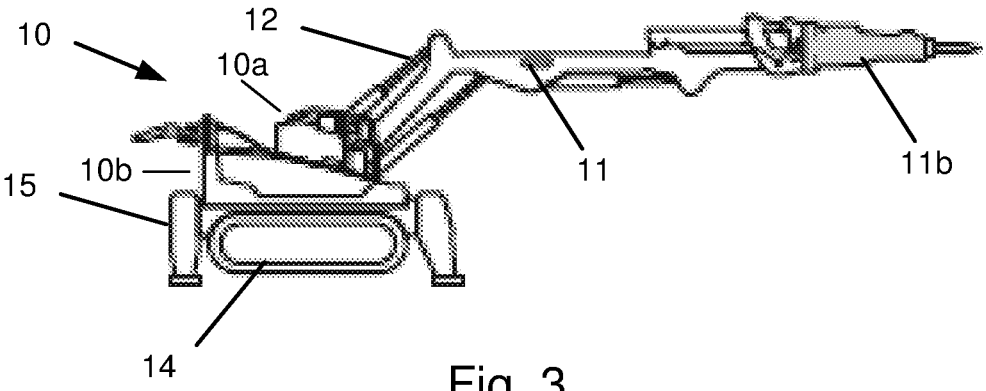
FIG. 3 shows a schematic view of a robot according to an embodiment of the teachings herein.

FIG. 3 shows a schematic view of a robot 10 according to FIG. 1. In FIG. 3, the caterpillar tracks 14, the outriggers 15, the arms 11 and the hydraulic cylinders 12 are shown. A tool 11*b*, in the form of a hammer 11*b*, is also shown (being shaded to indicate that it is optional).

As the controller 17 receives input relating for example to moving a robot member 11, for example from any of the joysticks 24, the corresponding valve 13*a* is controlled to open or close depending on the movement or operation to be made. One example of such movements is moving a robot member 11. One example of such operations is activating a tool 11*b* such as a hammer.

Figure 4:
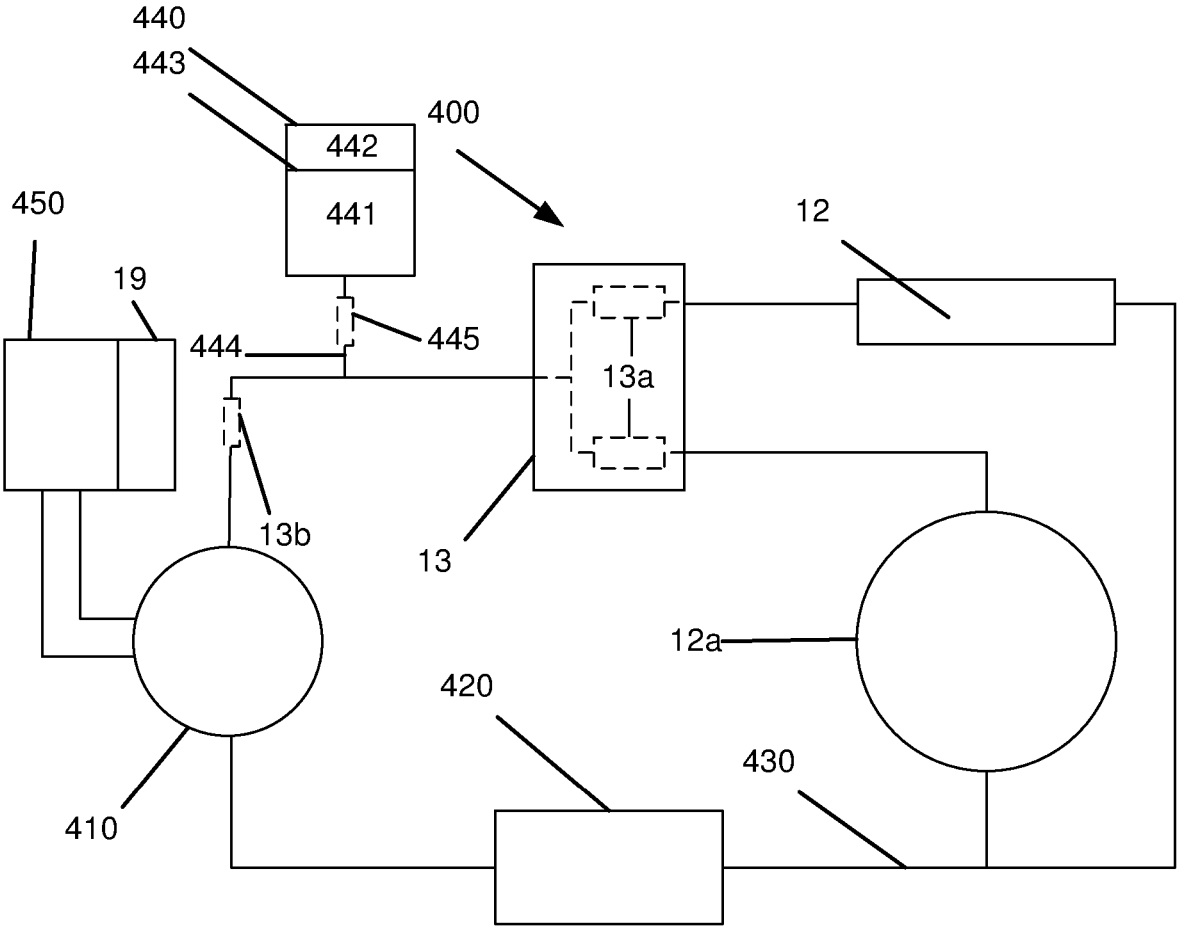
FIG. 4 shows a schematic view of a hydraulic system according to an embodiment of the teachings herein.

FIG. 4 shows a schematic view of a hydraulic system 400 for use in a demolition robot. The demolition robot may be electrically power. The demolition robot may alternatively be a combustion engine powered robot. The description herein will focus on an electrically powered demolition robot.

The hydraulic system 400 comprises a pump 410, that is driven by an electric motor 450. The pump 410 is used to provide flow in the hydraulic system 400, which flow is propagated to one or more actuators, such as a cylinder 12 or for example a hydraulic motor 12*a*. The actuators 12 may be used to move an arm 11*a*, or to power a tool 11*b*.

The hydraulic system 400 also comprises a fluid tank 420 for holding a hydraulic fluid (most often oil) which is led to the various components through conduits 430.

To enable control of a specific actuator 12, a valve block 13 is used comprising several valves (referenced 13*a* in FIG. 1). As one valve is opened, a corresponding actuator 12 is activated.

The motor 450 being provided with power from a power source, such as a power cable 19, is operated at power level of 10 amperes during normal movement wherein the motor 450 may drive the caterpillar tracks 14. However, if the tools are to be used, the power required to provide enough hydraulic flow and thereby pressure may increase the overall power consumption to 20 (or possibly even higher) amperes.

In situations, such as described above, where for example only low power outlets of 16 amperes or less are available, this will simply not be possible, rendering the demolition robot ineffective.

The inventors have realized that a hydraulic gas accumulator may be used to buffer energy for the demolition robot 10.

A hydraulic gas accumulator, being an example of an energy accumulator, comprises at least two compartments wherein a first 441 holds the hydraulic and a second 442 holds a compressible gas such as Nitrogen (N2). The two compartments are separated by a membrane 443. The accumulator works so that as the pressure in the first compartment rises, so does the pressure in the second compartment 442 as the membrane propagates the pressure and the gas is compressed. By regulating the propagation of pressure to/from the first compartment 441 through a valve 444, the pressure in the second compartment 442 may thus be used to store energy.

A membrane hydraulic gas accumulator such as disclosed above, is one example of a hydraulic gas accumulator that can be used. Other examples include piston gas accumulators and bladder gas accumulators.

By using a proportional valve 444, the accumulator may be charged or discharged according to the operating instructions of the controller 17.

The inventors have therefore devised a clever and insightful arrangement for utilizing an accumulator as an energy buffer in that when the demolition robot is connected to an electric power grid providing power levels higher than what is required by the hydraulic system 400, the accumulator 440 may be charged. And, when the flow (Q) requirements are higher than what the electric grid may provide, the accumulator 440 may be used to increase the hydraulic flow, thereby enabling operation also when the demolition robot is connected to an electric power grid providing lower power levels. This arrangement may also be used so that the pump 410 does not need to be overworked (i.e. forced to deliver more than its capacity) which would stall the hydraulic system 400.

Using a hydraulic gas accumulator has the benefit of a reduced complexity and cost compared to a battery. The hydraulic gas accumulator also has a longer live expectancy than a battery. The use of an accumulator also saves on power and makes any existing battery last longer.

The inventors have also realized that there is a problem in how to determine when to charge and when to discharge the accumulator as it is not possible to measure the flow in the various tools as they have no flow sensors. As would be understood, the manner taught herein would be beneficial if it could be used with all tools, not only specifically developed tools.

The inventors have therefore conceived a manner of determining the flow indirectly as will be explained in detail below.

The controller is thus configured to determine if the available flow is higher than required, and if so, charge the accumulator 440 through the proportional valve 444. Furthermore, the controller is also configured to determine if the available flow is lower than required, and if so, discharge the accumulator 440 through the proportional valve 444 to increase the flow in the hydraulic system using the buffered energy in stored the accumulator 440.

The controller is also enabled to determine that the pressure is not increased over the physical limits of the membrane 443. If so, the pressure accumulator 440 is no longer charged (or possibly discharged to lower the pressure).

Furthermore, the controller is enabled to prevent the accumulator 440 from being emptied.

Figure 5:
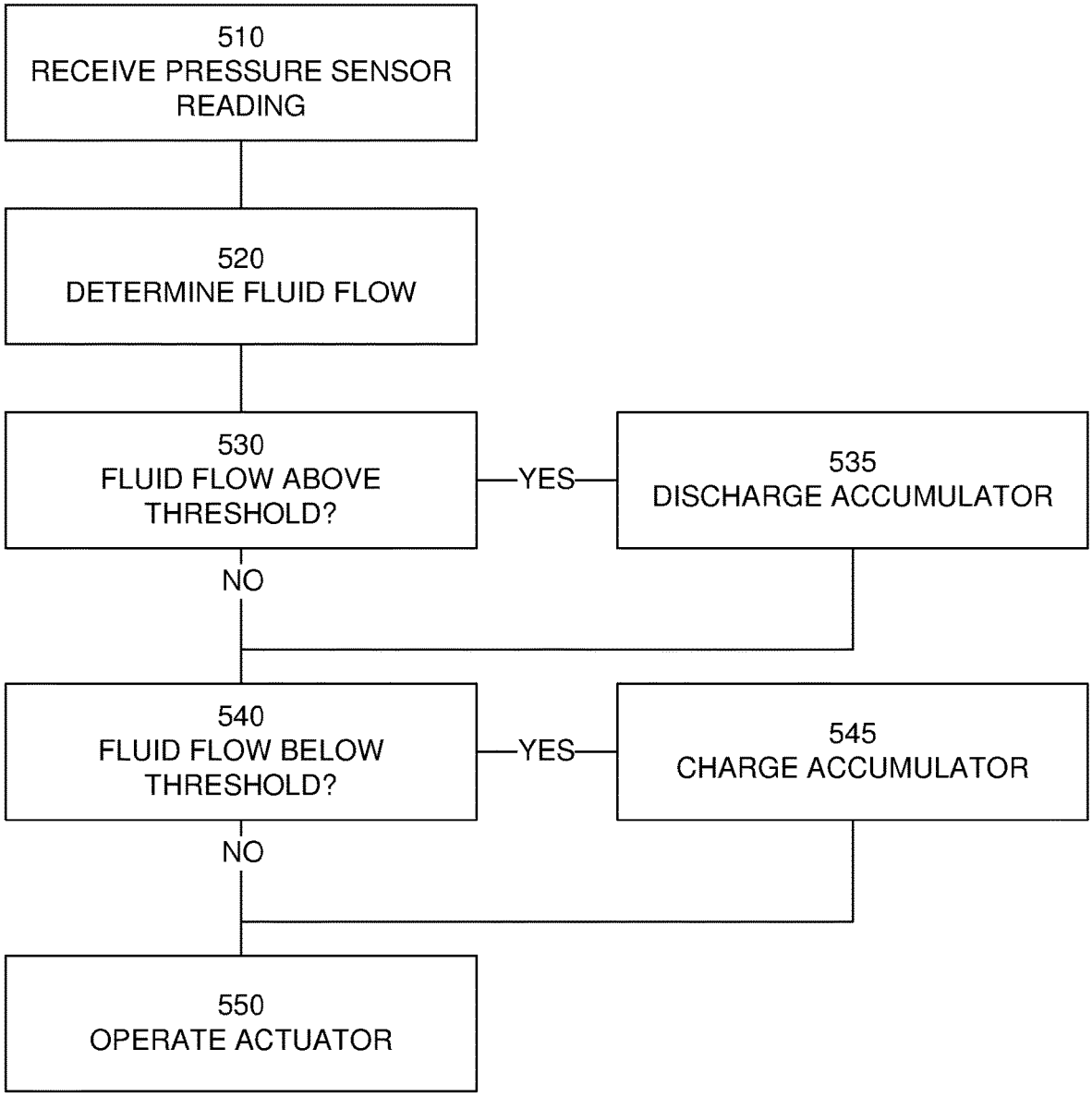
FIG. 5 shows a flowchart for a general method according to an embodiment of the teachings herein.

FIG. 5 shows a flowchart for a general method according to herein. The controller 17 receives 510 a pressure sensor reading from a pressure sensor 13*b* arranged at a valve 13*a* corresponding to an actuator 12. Based on the pressure sensor reading at the valve 13*a*, the controller determines 520 a fluid flow through the actuator 12 corresponding to the valve 13*a*. Hence, the fluid flow is determined indirectly by the use of a pressure sensor. Based on the determined fluid flow, the controller determines whether the accumulator should be charged or discharged. If the determined fluid flow is above 530 a first threshold value, the accumulator is discharged 535 to provide more energy to the system. If the determined fluid flow is below 540 a second threshold value, the accumulator is charged 545 to store energy for the system. The robot 10 is thus enabled to operate 550 the actuator 12 even if the supplied current is not as high as required.

The first and second thresholds may be the same. The threshold values may be dependent on the current operation requirements.

Figure 6:
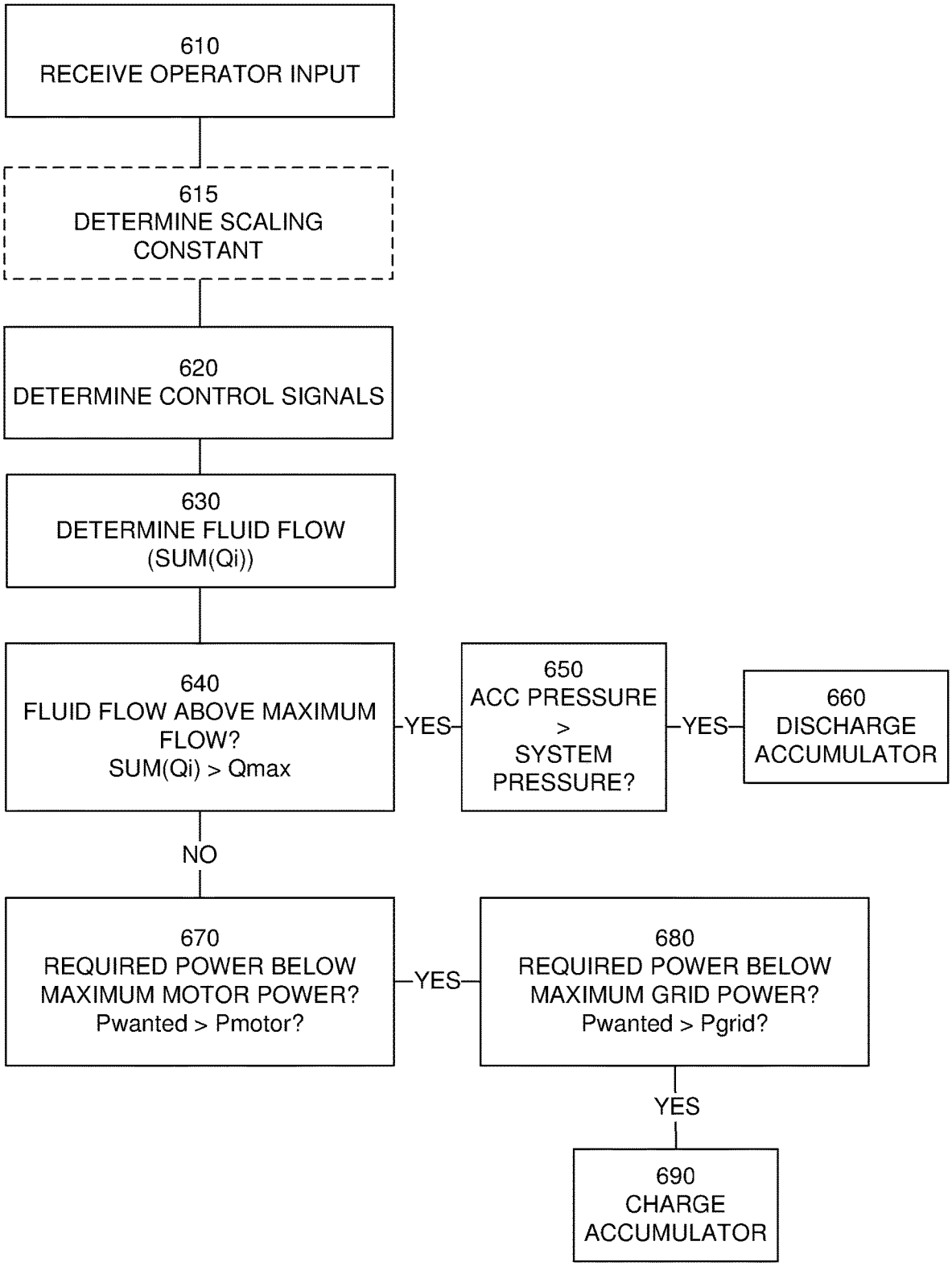
FIG. 6 shows a flowchart for a general method according to an embodiment of the teachings herein.

FIG. 6 shows a flowchart for a method of controlling an energy buffer for a remote controlled demolition robot.

A first pressure sensor 13*b* is arranged to provide an indication of the pressure in the hydraulic system 400 and a second pressure sensor 445 is arranged at the accumulator 440 and to provide an indication of the pressure in the accumulator 440.

The controller 17 controls the members 11 electrically by transmitting electrical control signals to the corresponding valve(s) 13*a*. Based on the control signals' levels, the flow (Qi) may be determined for each valve and the controller is configured to determine whether the total needed or required flow (Sum(Qi)) is higher than the maximum available flow Qmax, that the pump 410 is able to provide.

If the total required flow Sum(Qi) is lower than the maximum available flow Qmax, then the controller is arranged to open the valve 444 to the accumulator 440 so that the accumulator 440 is charged, thereby buffering energy.

To be able to properly charge the accumulator 440, the controller 17 is also arranged to determine that the required power (Pwanted=(Sum(Qi)*P1)/600, where P1 is the pressure of the hydraulic system provided by the first pressure sensor) is less than the power that the electric grid that the demolition robot is connected to 8 alternatively the maximum battery power) or the motor/engine that the remote controlled demolition robot is powered by, is able to provide Pmax. That is, if Pwanted<Pmax then it is possible to charge the accumulator.

If the total required flow Sum(Qi) is higher than the maximum available flow Qmax, then the controller is arranged to open the valve 444 to the accumulator 440 so that the accumulator 440 may be used to provide buffered energy by releasing some of the pressure stored in the accumulator 440.

To be able to discharge the accumulator, the controller 17 is arranged to determine that the pressure in the accumulator 440 P2, given by the second pressure sensor 445, is higher than the system pressure P1 provided by the first pressure sensor 13*b*.

Returning to FIG. 6 a flowchart for a method according to herein will now be discussed. The controller 17 receives operator input 610 from the control unit 22 and generates control signals to be transmitted 620 to the corresponding valves 13*a*. The control signals may be determined to be the operator input received.

Based on the control signals, the corresponding flows Qi are determined 630 (the flow being a function of the valve's characteristics and the control signal to be transmitted to the valve 13*a*).

The controller 17 then determines if the required fluid flow Sum(Qi) is higher than the maximum flow 640 that the pump is able to provide Qmax, and if so, determine if the pressure in the accumulator (received from the second pressure sensor 445) is higher than the system pressure 650 (received from the first pressure sensor 13*b*), and if so discharge the accumulator 660 thereby utilizing the buffered energy.

If the required fluid flow Sum(Qi) is not higher than the maximum flow 640 that the pump is able to provide Qmax, the controller 17 determines 670 if the required power Pwanted (for operating the pump 410) is below the maximum power that the motor is able to provide Pmotor, and if so the controller 17 may also determine 680 if the required power Pwanted (for operating the pump 410) is below the maximum power that the electric grid or battery is able to provide Pgrid, and if so the valve 444 is opened to enable charging of the accumulator 440, thereby buffering energy. The motor power and the grid power are examples of a maximum power that the motor or other power supply can provide and that indicates whether there is enough power to charge the accumulator or not.

In other cases, the controller 17 closes the valve 444 and returns to receive further operator input. In this embodiment, the first and second thresholds are thus the same, namely the maximum flow that the pump may provide.

To enable temporary overload of the motor and/or the fuse (for the grid or battery), the controller 17 may be configured to determine 615 a scaling constant K to be applied to all control signals. The scaling factor has a value between 0 and 1. This scaling of the control signals is optional as is indicated by the dashed lines.

Figure 7:
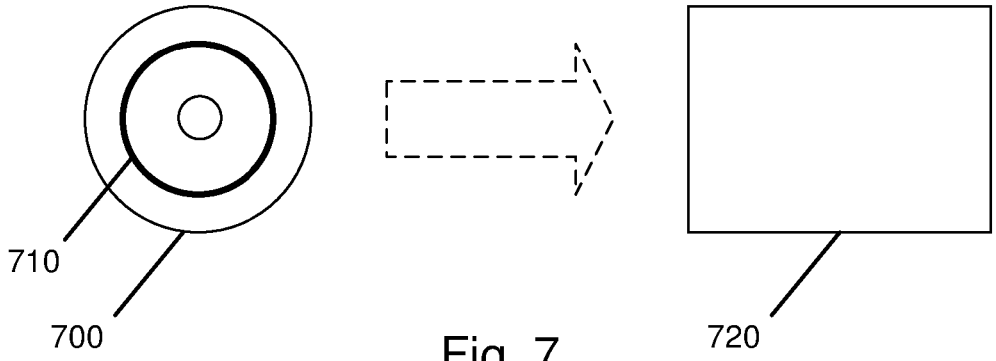
FIG. 7 shows a schematic view of a computer-readable product comprising instructions for executing a method according to one embodiment of the teachings herein.

FIG. 7 shows a computer-readable medium 700 comprising software code instructions 710, that when read by a computer reader 720 loads the software code instructions 710 into a controller, such as the controller 17, which causes the execution of a method according to herein. The computer-readable medium 700 may be tangible such as a memory disk or solid state memory device to mention a few examples for storing the software code instructions 710 or untangible such as a signal for downloading or transferring the software code instructions 710.

By utilizing such a computer-readable medium 700 existing robots 10 may be updated to operate according to the invention disclosed herein.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A remote controlled demolition robot comprising:

a controller;

a hydraulic system comprising at least one valve and a hydraulic gas accumulator;

at least one actuator configured to be controlled by the hydraulic system;

a system pressure sensor configured to measure a pressure in the hydraulic system; and an accumulator pressure sensor configured to measure a pressure in the accumulator;

wherein the controller of the remote controlled demolition robot is configured to:

determine whether the pressure in the accumulator from the accumulator pressure sensor is greater than the pressure in the hydraulic system from the system pressure sensor;

cause the accumulator to, in response to a level of power required by the hydraulic system being higher than a level of power being provided by an electric power source and determining that the pressure in the accumulator is greater than the pressure in the hydraulic system, discharge to increase a flow of fluid to the hydraulic system to provide power to the at least one actuator; and cause the accumulator to, in response to the level of power required by the hydraulic system being lower than the level of power being provided by the electric power source, charge to buffer power from the hydraulic system.

2. The remote controlled demolition robot according to claim 1, wherein the at least one valve is a hydraulic valve for controlling an inlet and/or an outlet to/from the accumulator.

3. The remote controlled demolition robot according to claim 2, wherein the accumulator is discharged through the hydraulic valve to increase the flow of fluid in the hydraulic system using the power buffered from the hydraulic system, and wherein the accumulator is charged by opening the hydraulic valve.

4. The remote controlled demolition robot according to claim 2, wherein the hydraulic valve is a proportional valve.

5. The remote controlled demolition robot according to claim 1, wherein the controller is configured to determine the flow of fluid in the hydraulic system indirectly.

6. The remote controlled demolition robot according claim 5, wherein the controller is further configured to determine the flow of fluid based on the pressure in the hydraulic system by the system pressure sensor at the at least one valve.

7. The remote controlled demolition robot according to claim 1, wherein the remote controlled demolition robot further comprises at least one robot arm member being movably operable via the at least one actuator.

8. The remote controlled demolition robot according to claim 1, wherein the accumulator comprises a first compartment and a second compartment being separated by a membrane, the first compartment being configured to hold the fluid and the second compartment being configured to hold a compressible gas.

9. The remote controlled demolition robot according to claim 1, wherein the remote controlled demolition robot is electrically powered.

10. The remote controlled demolition robot of claim 1, wherein the accumulator pressure sensor is disposed proximate to the accumulator.

11. The remote controlled demolition robot of claim 1, wherein the system pressure sensor is a collection of valve pressure sensors, wherein each leg of a valve block of the at least one valve has a respective valve pressure sensor.

12. The remote controlled demolition robot of claim 1, wherein the controller is configured to, based on the pressure in the accumulator and the pressure in the hydraulic system, apply two control thresholds for defining a charge condition, a discharge condition, and a condition where pump power is sufficient and no charging or discharging of the accumulator is performed.

13. A demolition robot comprising:

a controller; and at least one actuator controlled through a hydraulic system comprising at least one valve and a hydraulic gas accumulator;

wherein the controller is configured to:

determine a required fluid flow at the at least one actuator in the hydraulic system;

determine if the required fluid flow at the at least one actuator in the hydraulic system is above a first threshold, and if so discharge the accumulator to provide power to the at least one actuator; and determine if the required fluid flow in the hydraulic system is below a second threshold, and if so charge the accumulator for buffering power from the hydraulic system;

wherein the first threshold has a different fluid flow value than the second threshold.

14. The demolition robot according to claim 13, wherein the accumulator discharges through the at least one hydraulic valve of the hydraulic system to increase the flow of fluid in the hydraulic system using the power buffered from the hydraulic system, and wherein the accumulator is charged by opening the at least one hydraulic valve.

15. The demolition robot according to claim 14, wherein the at least one hydraulic valve is a proportional valve.

16. A method comprising:

receiving a first measurement of a pressure in a hydraulic system from a system pressure sensor;

receiving a second measurement of a pressure in a hydraulic gas accumulator from an accumulator pressure sensor;

determining whether the pressure in the hydraulic gas accumulator from the hydraulic accumulator pressure sensor is greater than the pressure in the hydraulic system from the system pressure sensor;

regulating a propagation of the pressure in the hydraulic gas accumulator via a membrane between a first compartment holding the fluid and a second compartment holding compressible gas to cause compression of the compressible gas to store power within the hydraulic gas accumulator;

discharging the fluid from the first compartment of the hydraulic gas accumulator to increase a flow of the fluid to the hydraulic system of a demolition robot to provide the power to an actuator of the hydraulic system, based on whether the pressure in the accumulator is greater than the pressure in the hydraulic system and in response to a level of power required by the hydraulic system being higher than a level of power being provided by an electric power source; and charging the hydraulic gas accumulator to buffer the power from the hydraulic system, in response to the demolition robot being connected to the electric power source, the level of power being provided by the electric power source being higher than the level of power required by the hydraulic system.

17. A non-transitory computer readable medium comprising software code instructions, that when loaded in and executed by a controller causes the execution of a method according to claim 16.

18. The method of claim 16, further comprising controlling operation of the actuator via the hydraulic system to cause movement of a breaker tool, a hammer tool, a cutter tool, a saw tool, or a digging bucket operably coupled to an arm of the demolition robot.

19. A remote controlled demolition robot comprising:

a controller;

a hydraulic system comprising at least one valve, and a hydraulic gas accumulator;

at least one actuator configured to be controlled by the hydraulic system;

a system pressure sensor configured to measure a pressure in the hydraulic system;

an accumulator pressure sensor configured to measure a pressure in the accumulator; and a battery;

wherein the controller of the remote controlled demolition robot is configured to:

determine whether the pressure in the accumulator from the accumulator pressure sensor is greater than the pressure in the hydraulic system from the system pressure sensor;

cause the accumulator to, in response to a level of power required by the hydraulic system being higher than a level of power being provided by an electric power source and determining that the pressure in the accumulator is greater than the pressure in the hydraulic system, discharge to increase the flow of fluid to the hydraulic system to provide power to the at least one actuator; and cause the accumulator to, in response to the level of power required by the hydraulic system being lower than the level of power being provided by the electric power source, charge to buffer power from the hydraulic system;

wherein the remote controlled demolition robot is arranged to operate solely or partially on battery power from the battery.

20. The remote controlled demolition robot of claim 1, wherein the controller is further configured to prevent the accumulator from being emptied.

* * * * *